US012187506B2

(12) United States Patent
Canlas et al.

(10) Patent No.: US 12,187,506 B2
(45) Date of Patent: Jan. 7, 2025

(54) SPINNABLE PACKAGE ASSEMBLY

(71) Applicant: Sanford L.P., Atlanta, GA (US)

(72) Inventors: Randel Kert Canlas, Charlotte, NC (US); Kaila Madison Sparkman, Huntersville, NC (US); Richard M. Good, III, Huntersville, NC (US)

(73) Assignee: Sanford, L.P., Atlanta, GA (US)

( * ) Notice: Subject to any disclaimer, the term of this patent is extended or adjusted under 35 U.S.C. 154(b) by 0 days.

(21) Appl. No.: 17/766,179

(22) PCT Filed: Oct. 7, 2020

(86) PCT No.: PCT/US2020/054491

§ 371 (c)(1),
(2) Date: Apr. 1, 2022

(87) PCT Pub. No.: WO2021/071883

PCT Pub. Date: Apr. 15, 2021

(65) Prior Publication Data

US 2024/0101303 A1 Mar. 28, 2024

Related U.S. Application Data

(60) Provisional application No. 62/912,606, filed on Oct. 8, 2019.

(51) Int. Cl.
*B65D 85/20* (2006.01)
*B65D 1/36* (2006.01)
(Continued)

(52) U.S. Cl.
CPC ..... *B65D 5/5213* (2013.01); *B65D 1/36* (2013.01); *B65D 5/4204* (2013.01); *B65D 5/503* (2013.01); *B65D 5/5097* (2013.01); *B65D 85/28* (2013.01)

(58) Field of Classification Search
CPC .... B65B 1/00; B65B 1/02; B65B 1/04; B65B 1/08; B65B 1/10; B65B 1/14; B65B 1/16;
(Continued)

(56) References Cited

U.S. PATENT DOCUMENTS 2,660,983 A * 12/1953 Lanning ..... A45C 11/34 206/486
3,433,351 A 3/1969 Zaborney
(Continued)

FOREIGN PATENT DOCUMENTS

DE 202017107355 U1 * 4/2018 ..... A63F 5/048
WO WO2001087732 A1 * 11/2001 ..... B65D 73/0092

OTHER PUBLICATIONS

International Search Reported for PCT/US2020/054491, Mailed Jan. 11, 2021, 2 pages.
(Continued)

*Primary Examiner* — Anthony D Stashick
*Assistant Examiner* — Marcos Javier Rodriguez Molina
(74) *Attorney, Agent, or Firm* — Eversheds Sutherland (US) LLP

(57) ABSTRACT

Spinnable packages and package assemblies for products are provided. Spinnable packages include a base having a plate with a top surface and an opposed bottom surface, and a protrusion extending from the top surface of the plate. The packages also include a wheel configured to removably secure a plurality of products, the wheel having an aperture extending therethrough, wherein the wheel and the base are sized and shaped such that the wheel is spinnably mountable on the base when the protrusion is positioned in the aperture, such that the wheel is spinnable about a longitudinal axis of the protrusion.

19 Claims, 15 Drawing Sheets

(51) Int. Cl.

| | |
|---|---|
| ***B65D 5/42*** | (2006.01) |
| ***B65D 5/50*** | (2006.01) |
| ***B65D 5/52*** | (2006.01) |
| ***B65D 85/28*** | (2006.01) |
| *A45C 11/36* | (2006.01) |

(58) Field of Classification Search

CPC .... B65B 1/22; B65B 1/28; B65B 1/30; B65B 1/32; B65B 1/36; B65B 1/363; B65B 1/366; B65B 1/385; B65B 11/00; B65B 11/004; B65B 11/02; B65B 11/025; B65B 11/04; B65B 11/045; B65B 11/06; B65B 11/18; B65B 11/22; B65B 11/46; B65B 11/50; B65B 11/54; B65B 11/58; B65B 11/585; B65B 13/06; B65B 13/12; B65B 13/18; B65B 13/185; B65B 13/32; B65B 15/04; B65B 17/02; B65B 17/025; B65B 19/34; B65B 2009/047; B65B 2011/002; B65B 2039/009; B65B 21/00; B65B 21/24; B65B 21/242; B65B 21/247; B65B 2210/00; B65B 2210/04; B65B 2210/06; B65B 2210/08; B65B 2210/16; B65B 2210/18; B65B 2210/20; B65B 2220/18; B65B 23/02; B65B 23/06; B65B 23/12; B65B 23/14; B65B 23/22; B65B 25/00; B65B 25/001; B65B 25/002; B65B 25/008; B65B 25/02; B65B 25/04; B65B 25/046; B65B 25/06; B65B 25/061; B65B 25/08; B65B 25/145; B65B 25/22; B65B 27/00; B65B 27/06; B65B 29/00; B65B 29/022; B65B 29/028; B65B 3/003; B65B 3/02; B65B 3/022; B65B 3/04; B65B 3/045; B65B 3/06; B65B 3/12; B65B 3/14; B65B 3/16; B65B 3/18; B65B 3/22; B65B 3/26; B65B 3/28; B65B 3/30; B65B 3/32; B65B 3/323; B65B 3/326; B65B 3/36; B65B 31/00; B65B 31/006; B65B 31/022; B65B 31/024; B65B 31/025; B65B 31/04; B65B 33/02; B65B 35/06; B65B 35/08; B65B 35/10; B65B 35/12; B65B 35/14; B65B 35/18; B65B 35/20; B65B 35/26; B65B 35/30; B65B 35/32; B65B 35/38; B65B 35/405; B65B 35/42; B65B 35/50; B65B 35/54; B65B 35/56; B65B 35/58; B65B 37/00; B65B 37/04; B65B 37/08; B65B 37/10; B65B 37/12; B65B 37/14; B65B 37/18; B65B 37/20; B65B 39/00; B65B 39/003; B65B 39/004; B65B 39/005; B65B 39/007; B65B 39/02; B65B 39/08; B65B 39/12; B65B 39/145; B65B 41/12; B65B 41/14; B65B 41/16; B65B 43/126; B65B 43/14; B65B 43/145; B65B 43/18; B65B 43/185; B65B 43/30; B65B 43/305; B65B 43/44; B65B 43/465; B65B 43/50; B65B 43/52; B65B 43/60; B65B 43/62; B65B 49/02; B65B 49/08; B65B 5/02; B65B 5/024; B65B 5/04; B65B 5/045; B65B 5/06; B65B 5/064; B65B 5/068; B65B 5/08; B65B 5/103; B65B 51/00; B65B 51/067; B65B 51/10; B65B 51/16; B65B 51/26; B65B 51/30; B65B 53/00; B65B 53/02; B65B 53/06; B65B 55/02; B65B 55/027; B65B 55/06; B65B 55/08; B65B 55/10; B65B 55/12; B65B 55/18; B65B 55/20; B65B 55/24; B65B 57/00; B65B 57/02; B65B 57/04; B65B 57/10; B65B 57/12; B65B 57/14; B65B 57/145; B65B 57/18; B65B 57/20; B65B 59/001; B65B 59/003; B65B 59/005; B65B 59/02; B65B 59/04; B65B 61/00; B65B 61/007; B65B 61/025; B65B 61/06; B65B 61/10; B65B 61/14; B65B 61/20; B65B 61/22; B65B 61/26; B65B 61/28; B65B 63/00; B65B 63/005; B65B 63/04; B65B 65/00; B65B 65/003; B65B 65/02; B65B 65/08; B65B 67/00; B65B 67/02; B65B 67/10; B65B 69/00; B65B 69/0033; B65B 69/0058; B65B 7/00; B65B 7/14; B65B 7/16; B65B 7/161; B65B 7/164; B65B 7/26; B65B 7/28; B65B 7/2807; B65B 7/2821; B65B 7/2842; B65B 7/285; B65B 7/2878; B65B 9/02; B65B 9/026; B65B 9/042; B65B 9/045; B65B 9/06; B65B 9/08; B65B 9/13; B65B 9/15; B65B 9/20; B65B 9/2049; B65D 1/02; B65D 1/0207; B65D 1/0215; B65D 1/0223; B65D 1/06; B65D 1/14; B65D 1/22; B65D 1/24; B65D 1/243; B65D 1/26; B65D 1/32; B65D 1/323; B65D 1/34; B65D 1/36; B65D 1/40; B65D 1/42; B65D 11/10; B65D 11/22; B65D 17/02; B65D 17/12; B65D 17/50; B65D 19/00; B65D 19/0034; B65D 19/0036; B65D 19/0053; B65D 19/0093; B65D 19/06; B65D 19/18; B65D 19/38; B65D 19/40; B65D 19/42; B65D 19/44; B65D 21/00; B65D 21/0201; B65D 21/0209; B65D 21/0212; B65D 21/0224; B65D 21/0228; B65D 21/023; B65D 21/0235; B65D 21/0237; B65D 21/0238; B65D 21/043; B65D 21/083; B65D 2203/00; B65D 2203/02; B65D 2203/06; B65D 2203/10; B65D 2203/12; B65D 2205/00; B65D 2205/02; B65D 2207/00; B65D 2209/00; B65D 2215/02; B65D 2215/04; B65D 2215/06; B65D 2231/005; B65D 2251/0018; B65D 2251/0093; B65D 2251/1025; B65D 2251/1033; B65D 2251/1058; B65D 2251/1066; B65D 23/02; B65D 23/0842; B65D 23/0878; B65D 2301/20; B65D 2313/10; B65D 25/00; B65D 25/005; B65D 25/02; B65D 25/04; B65D 25/06; B65D 25/08; B65D 25/087; B65D 25/10; B65D 25/107; B65D 25/108; B65D 25/14; B65D 25/20; B65D 25/205; B65D 25/24; B65D 25/28; B65D 25/2882; B65D 25/2897; B65D 25/30; B65D 25/42; B65D 25/52; B65D 25/54; B65D 25/56; B65D 2501/24019; B65D 2501/24267; B65D 2519/00034; B65D 2519/00069; B65D 2519/00104; B65D 2519/00174; B65D 2519/00268; B65D 2519/00273; B65D 2519/00278; B65D 2519/00288; B65D 2519/00293; B65D 2519/00318; B65D 2519/00323; B65D 2519/00333; B65D 2519/00343; B65D 2519/00502; B65D 2519/00517; B65D 2519/00527; B65D 2519/00567; B65D 2519/00572; B65D 2519/00587; B65D

2519/00611; B65D 2519/00646; B65D 2519/00791; B65D 2519/00805; B65D 2519/00815; B65D 2519/0084; B65D 2519/009; B65D 2519/00955; B65D 2519/00975; B65D 2519/0099; B65D 2539/003; B65D 2543/00138; B65D 2543/00194; B65D 2543/00296; B65D 2543/00435; B65D 2543/005; B65D 2543/00537; B65D 2543/00555; B65D 2543/00972; B65D 2543/0099; B65D 2571/00814; B65D 2571/00919; B65D 2575/362; B65D 2575/366; B65D 2575/367; B65D 2575/368; B65D 2577/048; B65D 2581/3422; B65D 2581/3427; B65D 2581/3433; B65D 2581/3452; B65D 2581/3456; B65D 2581/3464; B65D 2581/3466; B65D 2581/3472; B65D 2581/3474; B65D 2581/3477; B65D 2581/3478; B65D 2581/3479; B65D 2581/3487; B65D 2581/3489; B65D 2581/3494; B65D 2583/005; B65D 2583/0404; B65D 2583/0409; B65D 2583/0463; B65D 2583/0468; B65D 2583/0472; B65D 2583/0477; B65D 2583/0481; B65D 2583/0486; B65D 2583/049; B65D 2583/0495; B65D 2583/082; B65D 2585/56; B65D 2585/88; B65D 2590/046; B65D 27/00; B65D 3/10; B65D 31/00; B65D 31/02; B65D 31/10; B65D 31/12; B65D 31/16; B65D 31/18; B65D 33/00; B65D 33/004; B65D 33/008; B65D 33/02; B65D 35/02; B65D 35/04; B65D 35/08; B65D 35/10; B65D 35/12; B65D 35/14; B65D 35/24; B65D 35/28; B65D 35/34; B65D 35/36; B65D 35/46; B65D 35/56; B65D 37/00; B65D 39/0017; B65D 39/0029; B65D 41/0442; B65D 41/24; B65D 41/485; B65D 43/16; B65D 43/164; B65D 45/20; B65D 45/305; B65D 47/0809; B65D 47/0838; B65D 47/20; B65D 47/247; B65D 47/261; B65D 47/268; B65D 47/283; B65D 47/30; B65D 47/42; B65D 49/02; B65D 5/32; B65D 5/38; B65D 5/42; B65D 5/46024; B65D 5/48024; B65D 5/48038; B65D 5/503; B65D 5/5035; B65D 5/66; B65D 5/6602; B65D 5/6691; B65D 5/722; B65D 51/1616; B65D 51/20; B65D 51/32; B65D 53/02; B65D 61/00; B65D 65/14; B65D 65/406; B65D 65/42; B65D 71/08; B65D 71/42; B65D 73/0092; B65D 75/00; B65D 75/12; B65D 75/20; B65D 75/36; B65D 75/367; B65D 75/52; B65D 75/525; B65D 75/58; B65D 75/5811; B65D 75/5866; B65D 75/5872; B65D 75/5877; B65D 77/003; B65D 77/02; B65D 77/08; B65D 77/225; B65D 81/02; B65D 81/027; B65D 81/127; B65D 81/20; B65D 81/28; B65D 81/3205; B65D 81/3255; B65D 81/3261; B65D 81/3288; B65D 81/3461; B65D 83/00; B65D 83/0016; B65D 83/0022; B65D 83/0033; B65D 83/0094; B65D 83/02; B65D 83/0427; B65D 83/0445; B65D 83/0472; B65D 83/0481; B65D 83/0805; B65D 83/0829; B65D 83/20; B65D 83/205; B65D 83/22; B65D 83/228; B65D 83/267; B65D 83/30; B65D 83/54; B65D 83/546; B65D 85/00; B65D 85/02; B65D 85/1045; B65D 85/1048; B65D 85/10564; B65D 85/1081; B65D 85/20; B65D 85/30; B65D 85/32; B65D 85/321; B65D 85/36; B65D 85/50; B65D 85/70; B65D 85/73; B65D 85/8061; B65D 88/28; B65D 88/68; B65D 88/748; B65D 90/626; B65D 1/09; B65D 1/225; B65D 19/0004; B65D 2251/0031; B65D 2543/00092; B65D 2565/385; B65D 2565/388; B65D 2575/3245; B65D 2585/366; B65D 85/322; B65D 85/324; B65D 85/34; B65D 85/38; B65D 85/544; B65D 85/60; B65D 85/671; B65D 85/8043; B65D 85/8055; B65D 85/8058; B65D 88/32; B65D 88/54; B65D 88/546; B65D 90/0093; B65D 90/046; B65D 90/56; B65G 1/00; B65G 1/0464; B65G 1/0492; B65G 1/12; B65G 1/127; B65G 1/1375; B65G 1/1376; B65G 17/002; B65G 17/005; B65G 17/22; B65G 17/36; B65G 2201/0202; B65G 2201/0205; B65G 2201/0235; B65G 2201/0244; B65G 2201/0258; B65G 2201/0261; B65G 2201/045; B65G 2203/041; B65G 2207/08; B65G 2207/18; B65G 27/32; B65G 29/00; B65G 35/063; B65G 37/00; B65G 47/08; B65G 47/084; B65G 47/1428; B65G 47/1457; B65G 47/20; B65G 47/244; B65G 47/26; B65G 47/46; B65G 47/51; B65G 47/525; B65G 47/54; B65G 47/58; B65G 47/72; B65G 47/74; B65G 47/842; B65G 47/846; B65G 47/902; B65G 47/904; B65G 47/917; B65G 47/92; B65G 51/26; B65G 53/46; B65G 53/60; B65G 53/66; B65G 59/106; B65G 59/107; B65G 65/30; B65G 65/365; B65G 65/48; B65G 65/4818; B65G 65/0441; B65G 69/0458; B65G 69/18; B65G 1/02; B65G 1/04; B65G 1/0435; B65G 1/045; B65G 1/06; B65G 1/065; B65G 1/08; B65G 1/10; B65G 1/133; B65G 1/1371; B65G 1/1373; B65G 1/1378; B65G 1/18; B65G 11/203; B65G 13/10; B65G 15/30; B65G 17/12; B65G 17/123; B65G 17/20; B65G 19/02; B65G 19/08; B65G 21/14; B65G 2201/00; B65G 2201/02; B65G 2201/0211; B65G 2201/022; B65G 2201/0247; B65G 2201/0252; B65G 2201/027; B65G 2201/0282; B65G 2201/0285; B65G 2201/0297; B65G 2203/0216; B65G 2203/042; B65G 2203/043; B65G 2203/044; B65G 2203/046; B65G 2207/36; B65G 2207/46; B65G 2207/48; B65G 23/44; B65G 2814/0308; B65G 29/02; B65G 35/00; B65G 35/06; B65G 37/02; B65G 43/00; B65G 43/02; B65G 43/08; B65G 43/10; B65G 47/06; B65G 47/086; B65G 47/14;

B65G 47/1421; B65G 47/1464; B65G 47/1471; B65G 47/1478; B65G 47/1485; B65G 47/18; B65G 47/248; B65G 47/252; B65G 47/256; B65G 47/31; B65G 47/32; B65G 47/5104; B65G 47/5122; B65G 47/52; B65G 47/62; B65G 47/643; B65G 47/71; B65G 47/80; B65G 47/82; B65G 47/84; B65G 47/844; B65G 47/847; B65G 47/848; B65G 47/90; B65G 47/912; B65G 47/914; B65G 47/915; B65G 47/918; B65G 47/967; B65G 49/05; B65G 49/064; B65G 51/02; B65G 53/4616; B65G 53/4633; B65G 53/56; B65G 54/02; B65G 57/03; B65G 57/035; B65G 59/067; B65G 59/105; B65G 61/00; B65G 65/00; B65G 65/16; B65G 65/425; B65G 65/44; B65G 65/46; B65G 65/4836; B65G 65/4881; B65G 67/02; B65G 67/04; B65G 67/24; B65G 69/0441; B65G 69/181; B65H 15/02; B65H 16/005; B65H 16/06; B65H 18/28; B65H 19/12; B65H 19/18; B65H 2220/01; B65H 2220/02; B65H 2301/3125; B65H 2301/41246; B65H 2301/41342; B65H 2301/41346; B65H 2301/414425; B65H 2301/414428; B65H 2301/414446; B65H 2301/4148; B65H 2301/41745; B65H 2301/41912; B65H 2301/4311; B65H 2301/44712; B65H 2301/44765; B65H 2301/4482; B65H 2301/46064; B65H 2301/4607; B65H 2301/51532; B65H 2301/515323; B65H 2402/41; B65H 2402/412; B65H 2403/512; B65H 2403/942; B65H 2404/2211; B65H 2404/261; B65H 2404/632; B65H 2405/422; B65H 2406/3312; B65H 2406/34; B65H 75/28; B65H 75/2487; B65H 75/248; B65H 75/242; B65H 75/185; B65H 75/08; B65H 7/12; B65H 67/0428; B65H 57/20; B65H 54/82; B65H 54/80; B65H 54/48; B65H 51/10; B65H 5/28; B65H 5/228; B65H 5/12; B65H 5/08; B65H 5/062; B65H 5/023; B65H 5/021; B65H 49/38; B65H 49/328; B65H 49/322; B65H 49/305; B65H 49/28; B65H 49/00; B65H 45/22; B65H 45/12; B65H 45/04; B65H 43/08; B65H 43/00; B65H 39/11; B65H 39/10; B65H 37/06; B65H 37/02; B65H 37/007; B65H 37/005; B65H 37/00; B65H 35/10; B65H 35/0086; B65H 35/008; B65H 35/0073; B65H 35/0066; B65H 35/006; B65H 35/0033; B65H 35/0026; B65H 35/002; B65H 35/0006; B65H 33/12; B65H 33/10; B65H 31/36; B65H 31/3081; B65H 31/3045; B65H 31/3027; B65H 31/3009; B65H 31/10; B65H 31/04; B65H 3/24; B65H 3/10; B65H 29/6609; B65H 29/66; B65H 29/60; B65H 29/58; B65H 29/51; B65H 29/46; B65H 29/40; B65H 29/36; B65H 29/246; B65H 29/16; B65H 29/14; B65H 29/006; B65H 2801/78; B65H 2801/66; B65H 2701/534; B65H 2701/5122; B65H 2701/377; B65H 2701/32; B65H 2701/31; B65H 2701/19404; B65H 2701/192; B65H 2701/1916; B65H 2701/1914; B65H 2701/1912; B65H 2701/191; B65H 2701/19; B65H 2701/1846; B65H 2701/1764; B65H 2701/1752; B65H 2701/173; B65H 2701/1123; B65H 2555/26; B65H 2555/24; B65H 2515/30; B65H 2513/10; B65H 2511/52; B65H 2511/30; B65H 2511/23; B65H 2511/22; B65H 2511/12; B65H 2408/21; B65H 2408/113; B65H 2406/3124; B65H 2405/5521; B65H 2405/532; B65H 2404/63; B65H 2404/2693; B65H 2404/221; B65H 2404/14; B65H 2404/1114; B65H 2403/51; B65H 2403/421; B65H 2402/60; B65H 2402/10; B65H 2301/5154; B65H 2301/4631; B65H 2301/45; B65H 2301/44822; B65H 2301/44732; B65H 2301/4314; B65H 2301/42324; B65H 2301/42266; B65H 2301/42261; B65H 2301/42242; B65H 201/4213; B65H 2301/42122; B65H 2301/42112; B65H 2301/4172; B65H 2301/41446; B65H 2301/414436; B65H 2301/414421; B65H 2301/41369; B65H 2301/41306; B65H 2301/3411; B65H 2301/33224; B65H 2301/33222; B65H 2301/33216; B65H 2301/33212; B65H 2301/33; B65H 2301/3122; B65H 23/16; B65H 2220/11; B65H 2220/08; B65H 2220/04; B65H 19/30; B65H 19/29; B65H 19/2246; B65H 19/105; B65H 19/102; B65H 19/10; B65H 6/04; B65H 16/024; B65H 16/021; B65H 15/016; B65H 15/012; B65H 1/06

USPC ..... 216/214; 16/430, DIG. 12; 24/11 CT, 24/11 HC, 11 M, 11 R, 11 S; 33/11, 18.1, 33/18.2, 1 M, 23.01, 23.05, 24.3, 26, 33/32.4, 32.6, 438, 492, 546, 563, 774, 33/775; 74/10.54, 88, 96, 99 R; 81/177.1; 206/214, 216, 223, 339, 363, 206/366, 369, 425, 438, 455, 456, 486, 206/508, 533, 534, 536, 538, 539, 562, 206/565, 585; 227/105, 141, 81, 85; 312/231, 71, 72; D19/137, 181, 184, 85, D19/931

See application file for complete search history.

(56) References Cited

U.S. PATENT DOCUMENTS 4,454,971 A * 6/1984 Poehlmann ..... F42B 39/002 206/533
4,822,118 A * 4/1989 Watkins ..... B44D 3/04 312/305
4,915,256 A * 4/1990 Tump ..... B65D 83/0463 221/25
4,971,221 A * 11/1990 Urquhart ..... B65D 83/0463 221/25
5,076,444 A * 12/1991 Syms ..... A47F 3/10 211/163
5,562,231 A * 10/1996 Lambelet, Jr. ..... B65D 83/0454 221/25
D507,602 S * 7/2005 Siegel ..... D6/677.3
2003/0066769 A1 4/2003 Huang

(56) References Cited

U.S. PATENT DOCUMENTS

| | | | | |
|---|---|---|---|---|
| 2007/0056872 | A1* | 3/2007 | Begim | B65D 73/0057 206/461 |
| 2008/0110776 | A1* | 5/2008 | Sarkissian | A61C 19/008 206/83 |
| 2008/0230433 | A1* | 9/2008 | Mulaw | A45C 11/00 206/534 |
| 2009/0166245 | A1* | 7/2009 | Cetera | A47G 23/00 283/67 |
| 2018/0226621 | A1* | 8/2018 | Dorr | B65D 83/0454 |

OTHER PUBLICATIONS

International Preliminary Report on Patentability of PCT/US2020/054491, Completed on Oct. 18, 2021, 49 pages.

TheToyReviewer, "Sharpie 30 Permanent Markers Special Edition 3 Coloring Pages Unboxing Toy Review by TheToyReviewer", YouTube, https://www.youtube.com/watch?app=desktop&v=ILHSUr2Xuf8, Dec. 4, 2016.

Canadian Patent Office, Office Action, Application No. 3,156,992, dated Aug. 20, 2024, 6 pages.

* cited by examiner

SPINNABLE PACKAGE ASSEMBLY

CROSS REFERENCE TO RELATED APPLICATIONS

This application is a 35 U.S.C. § 371 national stage application of PCT Patent Application No. PCT/US2020/054491, filed Oct. 7, 2020, which claims priority benefit of U.S. Provisional Application No. 62/912,606, filed Oct. 8, 2019, the disclosures of which are incorporated by reference herein in their entireties.

FIELD OF DISCLOSURE

This disclosure generally relates to spinnable package assemblies, and more specifically relates to spinnable package assemblies for containing a plurality of products.

BACKGROUND

Product packages, and other package assemblies (referred to interchangeably, herein), have been in widespread use for decades. Package assemblies are used for a variety of applications in transportation and retail. Current package assemblies may not be engaging to users because the user is not able to engage with the packaging before purchasing the product. This may be a hassle if the potential purchaser would prefer to view the entirety of the plurality of products within the package before purchase. Indeed, most commercially available package assemblies do not permit user engagement.

To enable users to view the entirety of the plurality of products in packaging assemblies, some packaging assemblies are transparent. Alternatively, some packaging assemblies permit users to open the package and view its contents without breaking the package. However, such packaging assemblies involve limited or no user engagement. Various configurations to solve this issue have been utilized throughout the years, but none offers a truly user-friendly approach in addition to accounting for the ability of the user to view products within the package.

Accordingly, a need exists to create a simple, and engaging mechanism that enables users to view and engage with products within a package.

SUMMARY

In one aspect, spinnable packages are provided. A spinnable package includes a base that includes a plate having a top surface and an opposed bottom surface, and a protrusion extending from the top surface of the plate. The spinnable package also includes a wheel configured to removably secure a plurality of products, the wheel having an aperture extending therethrough, wherein the wheel and the base are sized and shaped such that the wheel is spinnably mountable on the base when the protrusion is positioned in the aperture, such that the wheel is spinnable about a longitudinal axis of the protrusion.

In another aspect, spinnable package assemblies are provided. A spinnable package assembly includes a spinnable package in combination with an outer box configured to substantially enclose the base and the wheel. The outer box includes a first face having a first cutout, a second face adjacent to the first face, a third face having a second cutout, wherein the third face is adjacent to the second face and is opposed to the first face, a fourth face, wherein the fourth face is adjacent to the third face and is opposed to the second face, a bottom face, wherein the bottom face is adjacent to the first face, the second face, the third face, and the fourth face, and a top face adjacent to the first face, wherein the top face is movable between a closed configuration in which the top face is adjacent to the first face, the second face, the third face, and the fourth face, and the top face is opposed to the bottom face, and an open configuration, in which the top face is adjacent to the first face.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
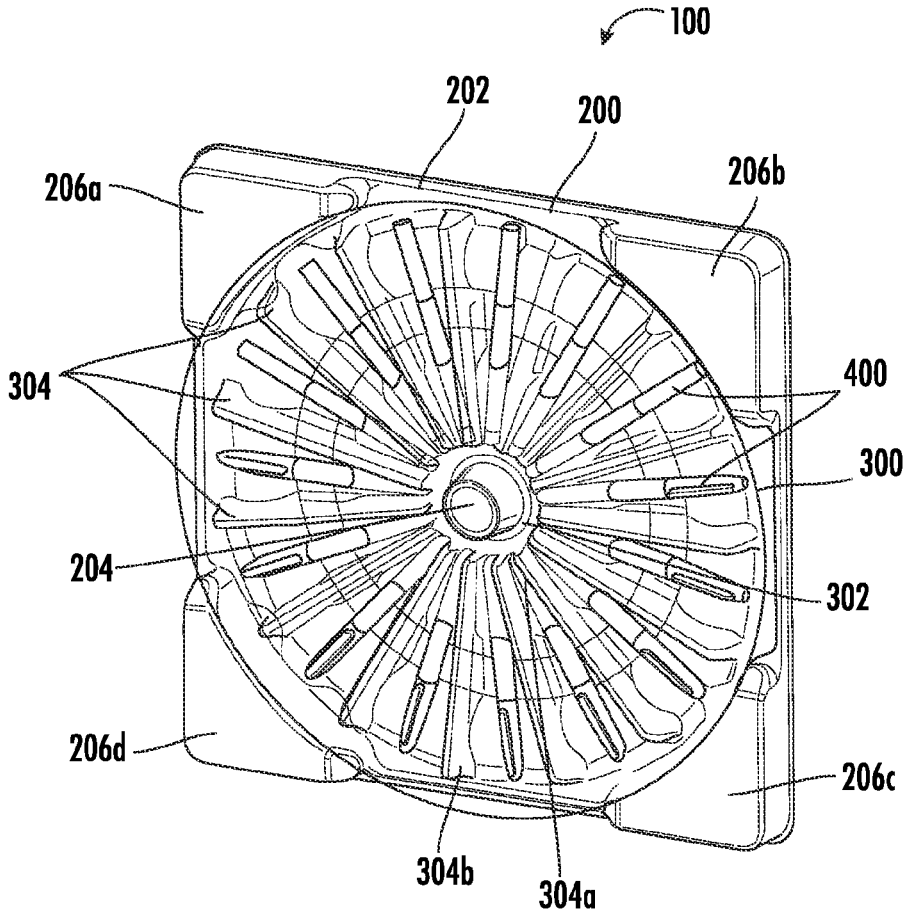
FIG. 1 is a perspective view of an embodiment of a spinnable package assembly according to the present disclosure.

The spinnable package assemblies described herein allow for an engaging and user-friendly packaged product. A spinnable package assembly generally may include a base, a wheel removably attached to the base, and an outer box configured to substantially enclose the base and the wheel. The present disclosure includes non-limiting embodiments of spinnable package assemblies.

While these spinnable package assemblies are generally described herein with respect to a plurality of writing instruments, it should be understood that the spinnable package assemblies described herein may be used to connect products other than writing instruments. For example, each product described herein may include Sharpie® and Paper Mate® products, or may include Elmer's® and Yankee Candle® products. Products could include pens, markers, highlighters, color pencils, mechanical pencils, glue sticks, other writing instruments and stationery products, and may include candles or tea lights.

The embodiments are described in detail herein to enable one of ordinary skill in the art to practice the spinnable package assembly, although it is understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

Certain relationships between features of the spinnable package assembly are described herein using the term "substantially" or "substantially equal." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. For example, the term "substantially equal" when used to refer to various dimensions of the outer box, wheel, and base, refers to a range of +/−five percent of the unit of measurement stated thereafter.

In one aspect, a spinnable package assembly includes a base, a wheel, and an outer box. The base may include a plate and a protrusion extending from the plate. The base may be formed of a single component, in which the plate and protrusion are integrally formed and/or permanently coupled to one another, or may be formed of multiple components, such as a plate and a protrusion that are separate components. In certain embodiments, the assembly also includes a stabilizing insert configured to stabilize the base within the assembly.

Figure 6A:
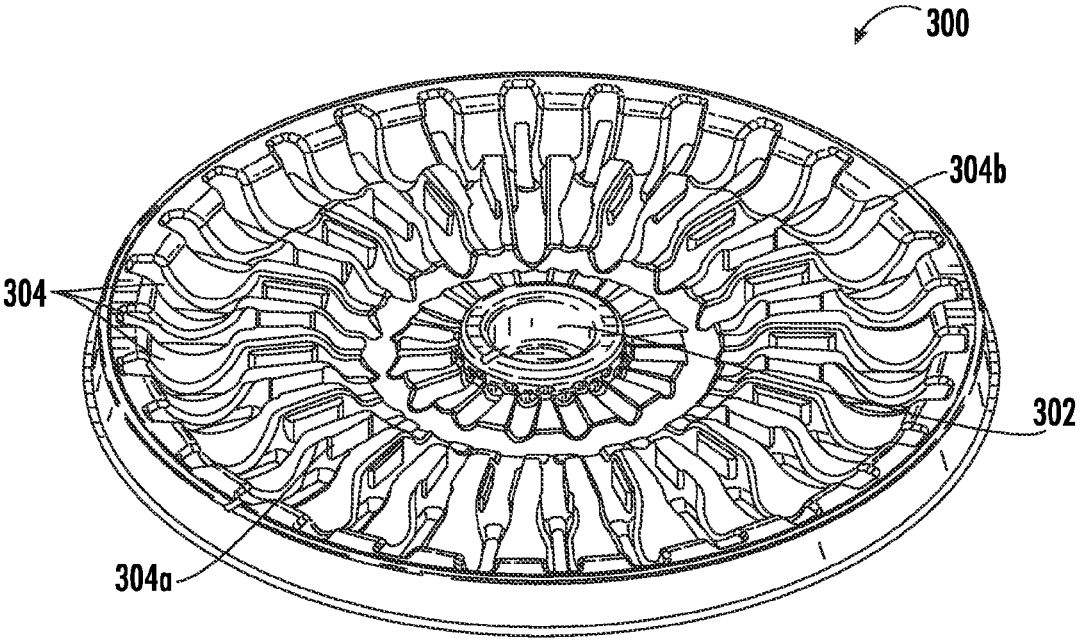
FIG. 6A is a perspective view of an embodiment of a wheel portion of a spinnable package assembly according to the present disclosure.
Figure 6B:
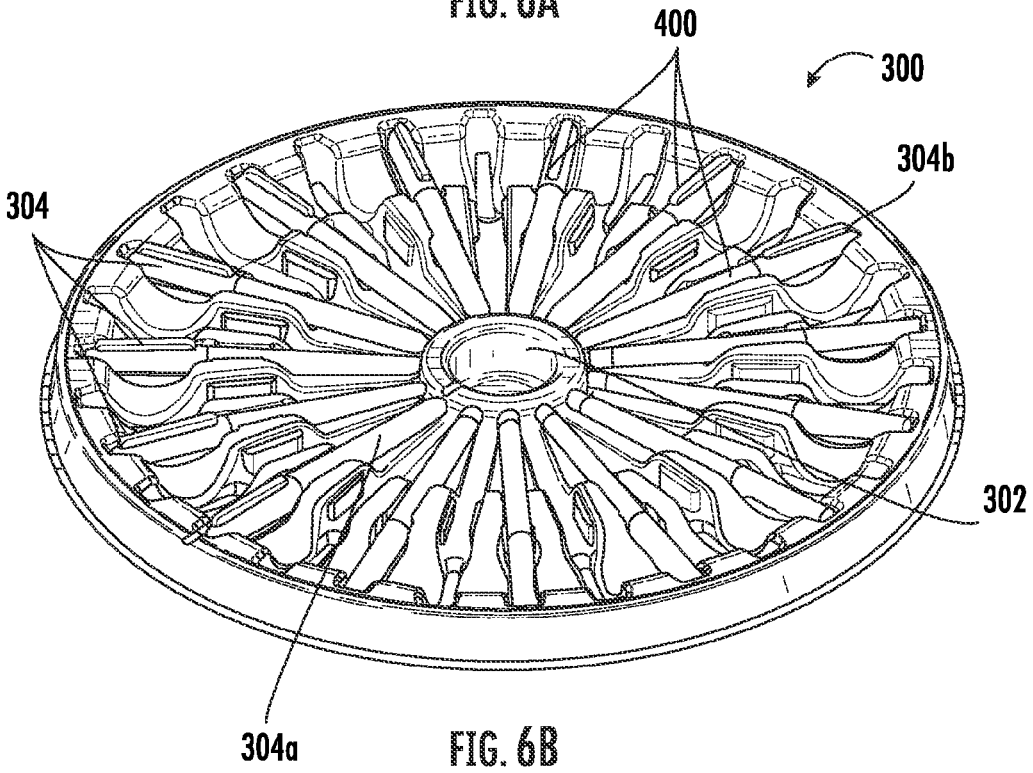
FIG. 6B is a perspective view of the wheel portion of the spinnable package assembly of FIG. 6A.
Figure 6C:
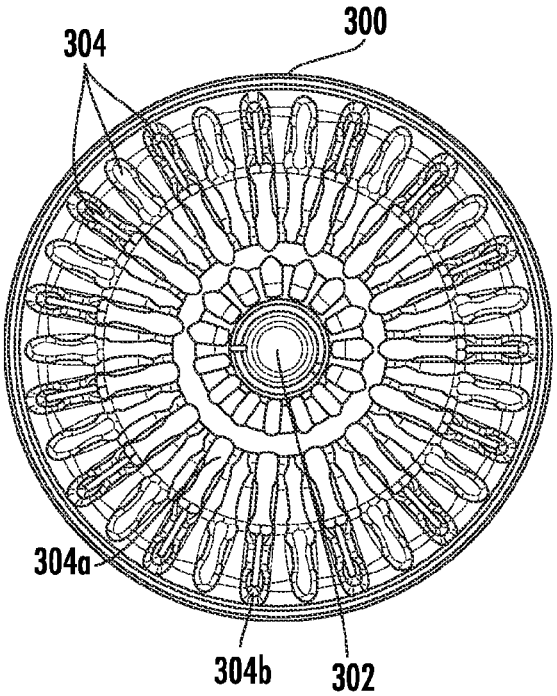
FIG. 6C is a top view of the wheel portion of the spinnable package assembly of FIG. 6A.
Figure 6D:
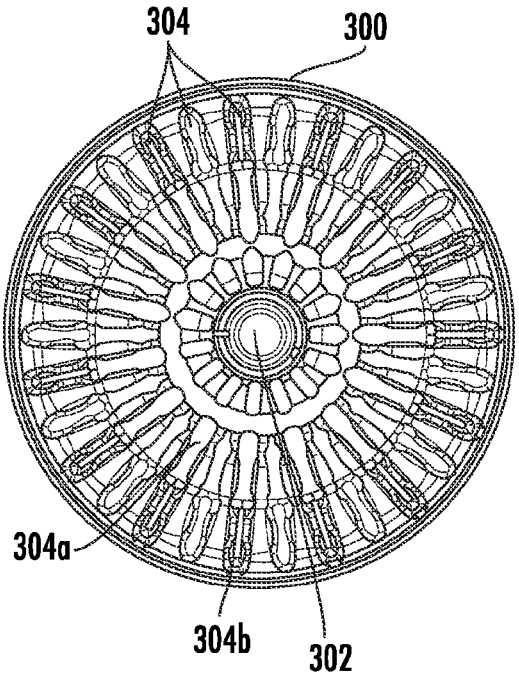
FIG. 6D is a bottom view of the wheel portion of the spinnable package assembly of FIG. 6A.
Figure 6E:
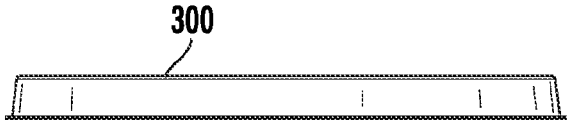
FIG. 6E is a front view of the wheel portion of the spinnable package assembly of FIG. 6A.
Figure 6F:
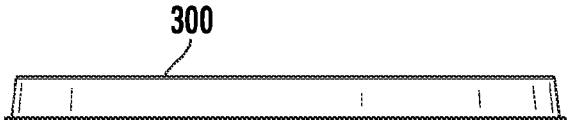
FIG. 6F is a back view of the wheel portion of the spinnable package assembly of FIG. 6A.
Figure 6G:
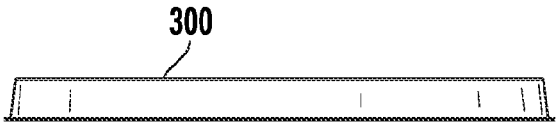
FIG. 6G is a left view of the wheel portion of the spinnable package assembly of FIG. 6A.
Figure 6H:
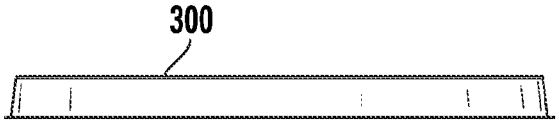
FIG. 6H is a right view of the wheel portion of the spinnable package assembly of FIG. 6A.
Figure 7A:
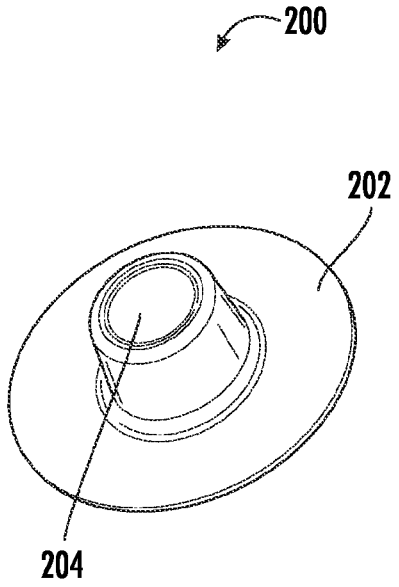
FIG. 7A is a perspective view of a base portion of a spinnable package assembly according to the present disclosure.
Figure 7B:
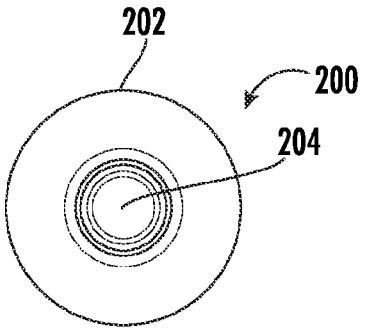
FIG. 7B is a top view of the base portion of the spinnable package assembly of FIG. 7A.
Figure 7C:
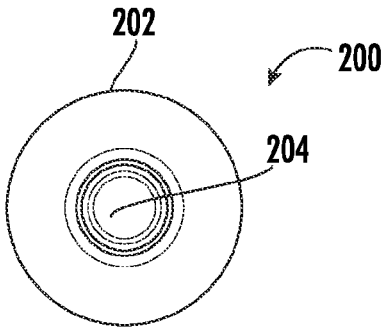
FIG. 7C is a bottom view of the base portion of the spinnable package assembly of FIG. 7A.
Figure 7D:
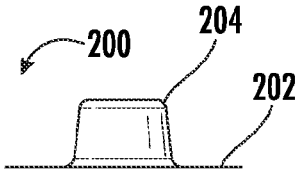
FIG. 7D is a front view of the base portion of the spinnable package assembly of FIG. 7A.
Figure 7E:
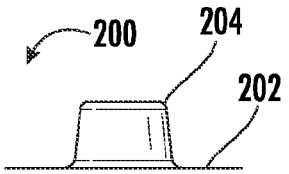
FIG. 7E is a back view of the base portion of the spinnable package assembly of FIG. 7A.
Figure 7F:
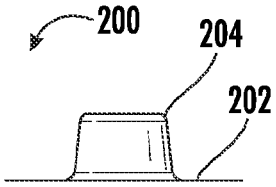
FIG. 7F is a left view of the base portion of the spinnable package assembly of FIG. 7A.
Figure 7G:
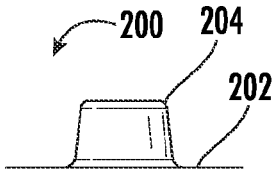
FIG. 7G is a right view of the base portion of the spinnable package assembly of FIG. 7A.

The wheel may include an aperture extending at least partially therethrough, and a plurality of cavities. The plurality of cavities may be configured to removably secure a plurality of products. The wheel may be removably mountable to the base by positioning the protrusion within the aperture. The aperture may extend fully through the wheel, such that the protrusion extends through the wheel when the wheel is positioned thereon. Alternatively, as illustrated in the figures, the aperture may extend from one surface of the wheel, through a majority of the width of the wheel, and be bounded at one end by a wall. That is, as shown in FIGS. 6A and 6B (which illustrates the wheel of FIG. 6A loaded with writing instruments and flipped over), the aperture 302 may be defined on one surface of the wheel 300 as an opening and on the opposite surface may be defined by a wall. Thus, when the wheel 300 is positioned on a protrusion, the distal end of the protrusion interfaces or engages the inner surface of the wall defining the aperture. In such embodiments, the relative widths and depths of the components may result in the wheel 300 being spaced from the adjacent surface of the outer box, effectively suspended, which may enhance its spinnability.

The outer box may include four side faces, a bottom face, and a top face. The outer box is configured to substantially enclose the base and the wheel. The outer box may also have two faces, each with a cutout. One benefit to the cutouts is that the wheel can be spun while the base and the wheel are disposed within the outer box.

Figure 2:
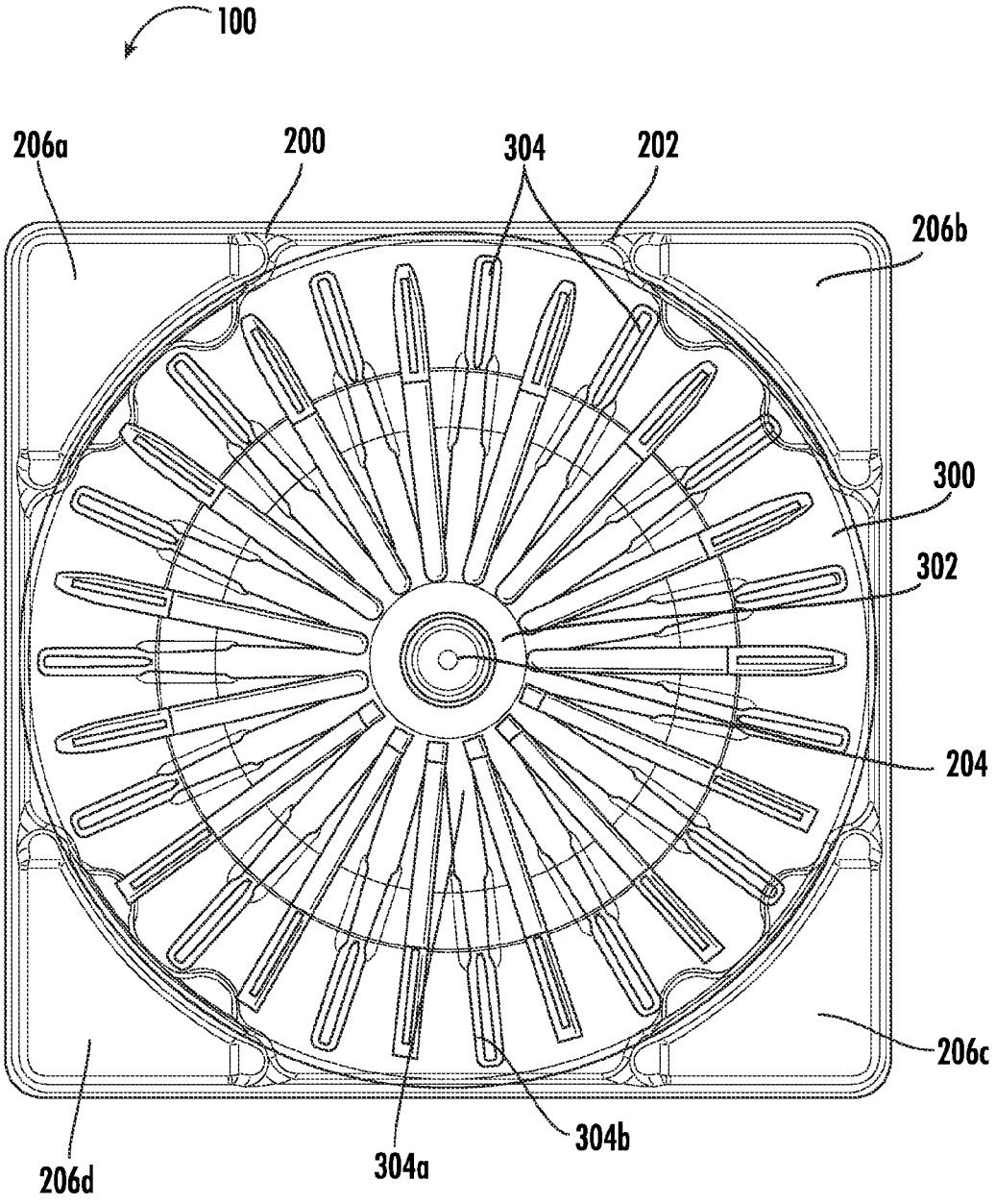
FIG. 2 is a front view of the spinnable package assembly of FIG. 1.
Figure 3:
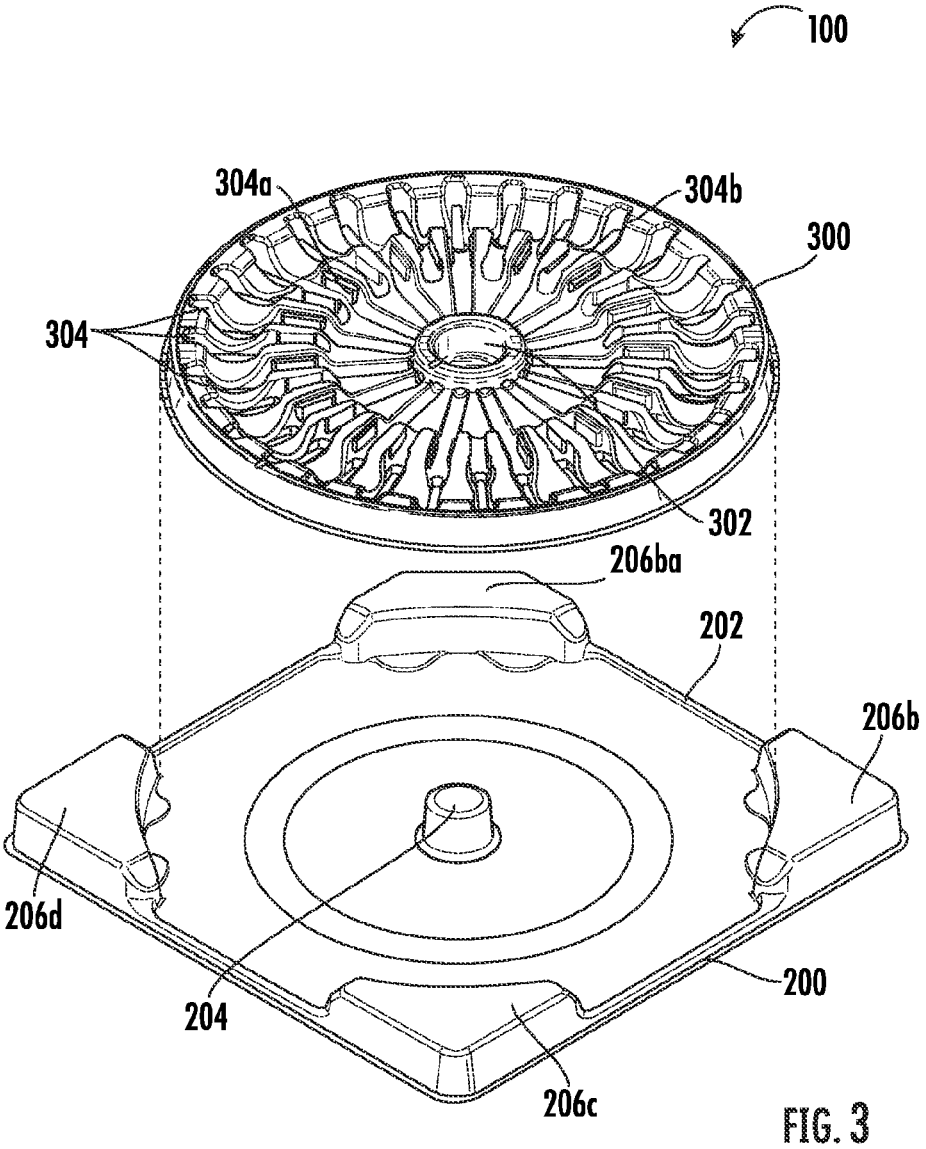
FIG. 3 is a perspective exploded view of the spinnable package assembly of FIG. 1.
Figure 4A:
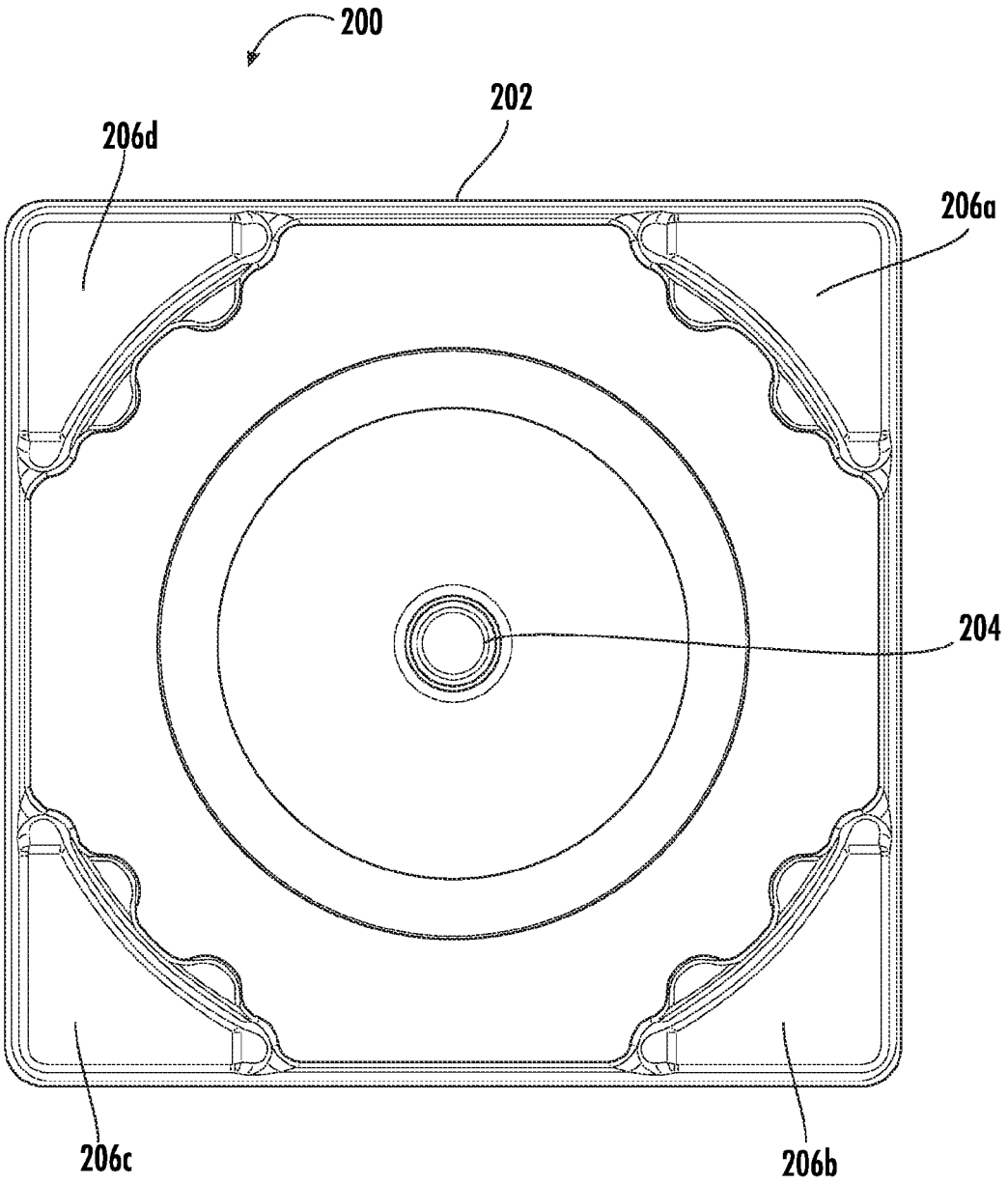
FIG. 4A is a top view of an embodiment of a base portion of a spinnable package assembly according to the present disclosure.
Figure 4B:
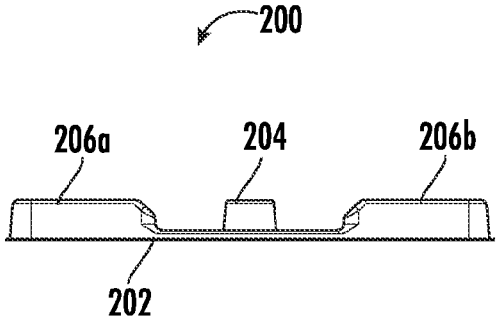
FIG. 4B is a front view of the base portion of the spinnable package assembly of FIG. 4A.
Figure 4C:
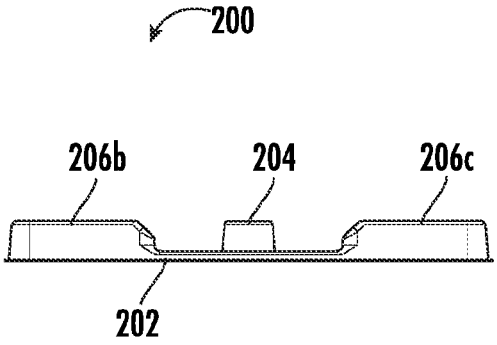
FIG. 4C is a back view of the base portion of the spinnable package assembly of FIG. 4A.
Figure 4D:
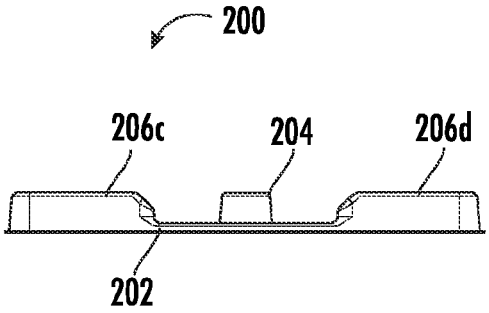
FIG. 4D is a left view of the base portion of the spinnable package assembly of FIG. 4A.
Figure 4E:
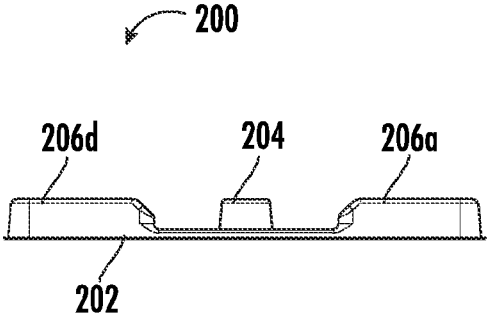
FIG. 4E is a right view of the base portion of the spinnable package assembly of FIG. 4A.
Figure 5A:
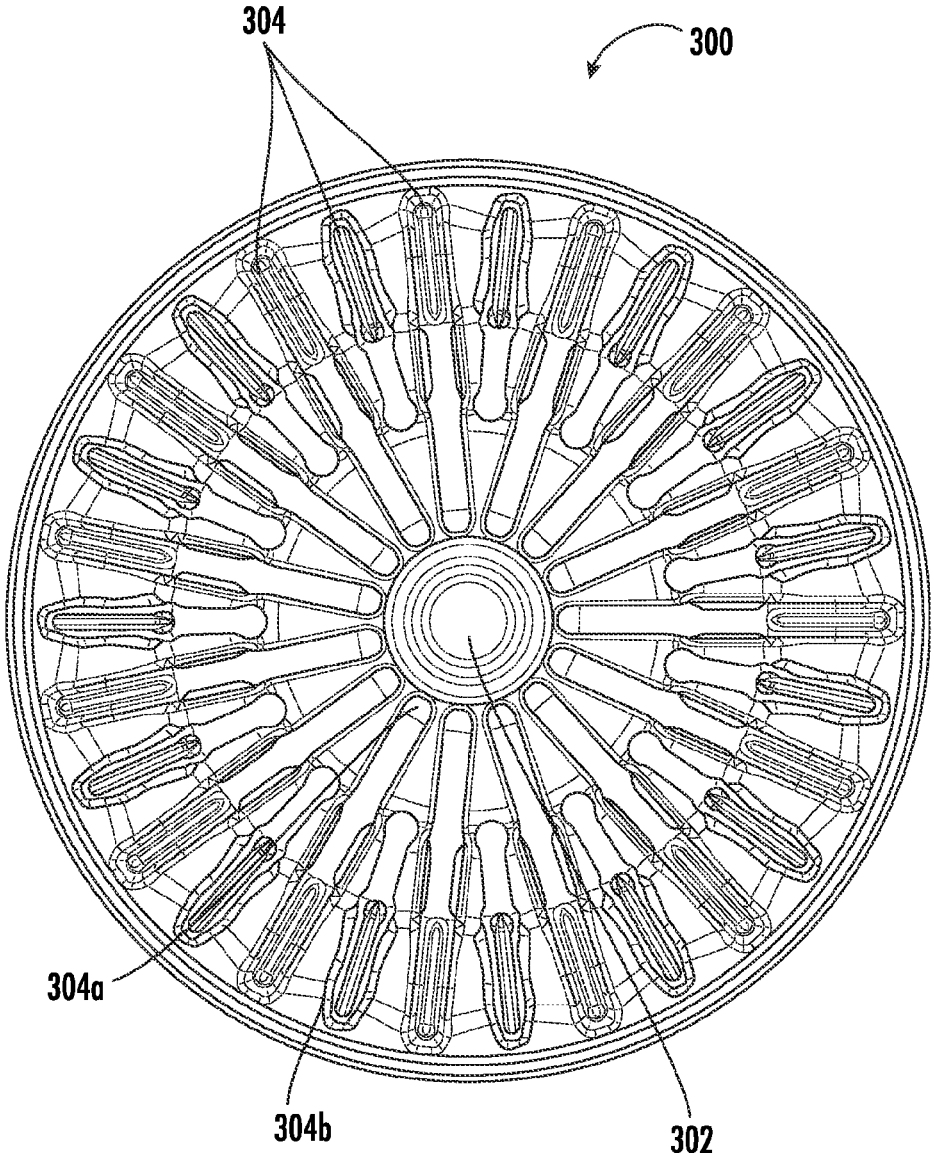
FIG. 5A is a top view of an embodiment of a wheel portion of a spinnable package assembly according to the present disclosure.
Figure 5B:
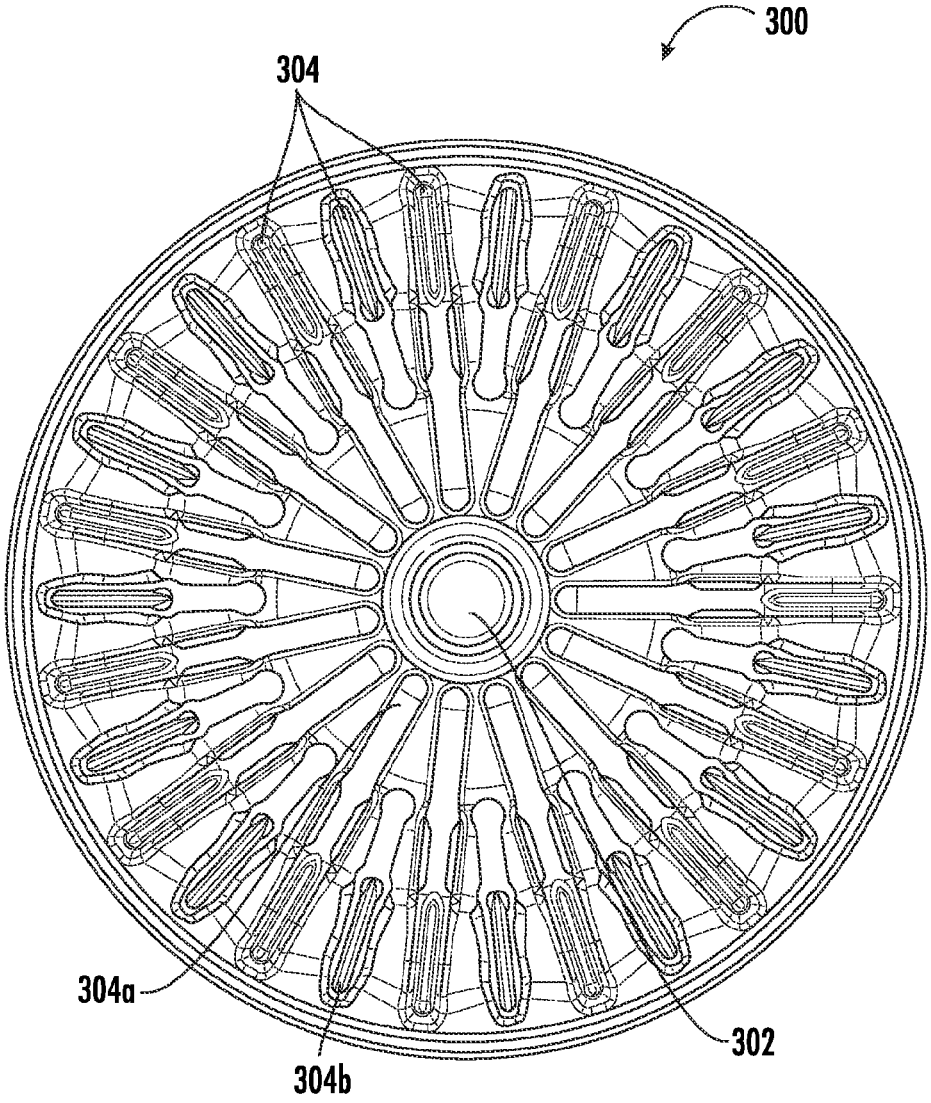
FIG. 5B is a bottom view of the wheel portion of the spinnable package assembly of FIG. 5A.
Figure 5C:
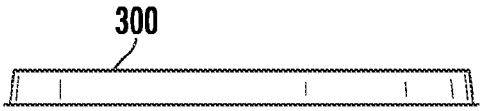
FIG. 5C is a front view of the wheel portion of the spinnable package assembly of FIG. 5A.
Figure 5D:
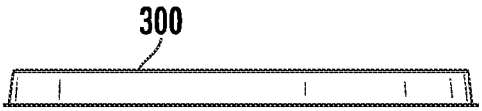
FIG. 5D is a back view of the wheel portion of the spinnable package assembly of FIG. 5A.
Figure 5E:
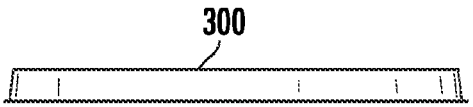
FIG. 5E is a left view of the wheel portion of the spinnable package assembly of FIG. 5A.
Figure 5F:
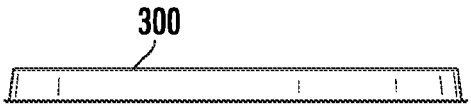
FIG. 5F is a right view of the wheel portion of the spinnable package assembly of FIG. 5A.

In certain embodiments, as shown in FIGS. 1, 2, and 3, a spinnable package assembly 100 includes a base 200 configured to engage with a wheel 300. For example, the base 200 may include a plate 202 having a top surface and an opposed bottom surface, and a protrusion 204 extending from the top surface of the plate. The plate 202 may be any suitable shape configured to allow a wheel 300 to be disposed on the top surface of the plate 202. The plate 202 may be formed of clear or colored plastic. In some embodiments, the plate 202 is rectangular or square. In other embodiments, as shown in FIGS. 7A-G, the plate 202 is substantially circular. In some embodiments, as shown in FIGS. 1-3 and 7A-G, the protrusion 204 is disposed on the center of the top surface of the plate 202. In some embodiments, the protrusion 204 may be substantially cylindrical. For example, the protrusion 204 may have a relatively flat surface on at least one side of the cylindrical protrusion 204.

In some embodiments, as in FIGS. 1, 2, 3, and 4A-E, the plate 202 includes a plurality of raised platforms 206. A first raised platform 206*a* is disposed at a first corner of the top surface of the plate 202. A second raised platform 206*b* is disposed at a second corner of the top surface of the plate 202. A third raised platform 206*c* is disposed at a third corner of the top surface of the plate 202. A fourth raised platform 206*d* is disposed at a fourth corner of the top surface of the plate 202. In some embodiments, as in FIGS. 1 and 2, the plurality of raised platforms 206 may be configured such that the wheel 300 may be disposed on the plate 202 without simultaneously being disposed on the plurality of raised platforms 206. For example, in such embodiments, the plate 202 may extend past the edge or circumference of the wheel.

In other embodiments, as shown in FIGS. 7A-7G, the plate 202 does not extend past the edge or circumference of the wheel. For example, the plate 202 may have a diameter or major dimension that is larger than the diameter or major dimension of the aperture 302 of the wheel 300 but smaller than the diameter or major dimension of the wheel 300. In such embodiments, spinnable package assembly may further include a stabilizing insert (such as 600 in FIG. 8C), which is configured to stabilize the base within the assembly. For example, the stabilizing insert may be sized and shaped to securely fit within the outer box 500 to stabilize the base, and thereby a wheel mounted thereon, within the box. For example, the stabilizing insert may be a suitable plastic, cardboard, or other material having sufficient rigidity and/or strength to maintain the base and a wheel mounted thereon in place within the outer box.

In certain embodiments, as seen in FIGS. 1, 2, 3, and 5A-F, the spinnable package assembly 100 includes a wheel 300 having an aperture 302 extending at least partially therethrough and a plurality of cavities 304. As used herein, the term "wheel" refers to a plate, tray, or the like, having a diameter or length, a height, and a depth. In some embodiments, the wheel 300 is substantially circular. The wheel 300 may be formed of clear or colored plastic. In some embodiments, the aperture 302 is substantially circular. In embodiments where the plate 202 is substantially circular, the diameter of the plate 202 is greater than the diameter of the aperture 302. The aperture 302 may be disposed at the center of the wheel 300. The wheel 300 may selectively attach to the base 200. In some instances, the wheel 300 is spinnably mountable on the base 200 when the protrusion 204 is positioned in the aperture 302. In this instance, the wheel 300 is spinnable about a longitudinal axis of the protrusion 204. The wheel 300 may be textured. For example, the wheel 300 may contain a plurality of cavities 304.

As described above, the aperture may extend fully through the wheel (i.e., each of the opposed surfaces of the wheel defines an opening of the aperture), such that the protrusion extends through the wheel when the wheel is positioned thereon. Alternatively, as illustrated in the figures, the aperture may extend from one surface of the wheel, defined by a sidewall, through a majority of the width of the wheel, and be bounded at one end by a wall transverse to the sidewall. That is, as shown in FIGS. 6A and 6B (which illustrates the wheel of FIG. 6A loaded with writing instruments and flipped over), the aperture 302 may be defined on one surface of the wheel 300 as an opening and on the opposite surface may be defined by a wall. Thus, when the wheel 300 is positioned on a protrusion, the distal end of the protrusion interfaces or engages the inner surface of the wall defining the aperture. In such embodiments, the relative widths and depths of the components may result in the wheel 300 being spaced from the adjacent surface of the outer box, effectively suspended, which may enhance its spinnability.

In certain embodiments, as shown in FIGS. 5A-B and 6A-H, the plurality of cavities 304 is configured such that the wheel 300 may removably secure a plurality of products 400. In this embodiment, the plurality of cavities 304 is also configured such that a first end of each of the plurality of cavities 304*a* is disposed proximal to the protrusion 204, and a second end of each of the plurality of cavities 304*b* is disposed proximal to the circumference of the wheel 300. In some embodiments, as shown in FIGS. 6A-H, the plurality of cavities 304 are configured such that the plurality of products 400 may be securely fastened when the plurality of cavities 304 receives the plurality of products 400. In some embodiments, as shown in FIG. 6B, at least a portion of the plurality of cavities 304 are configured to receive a plurality of Fine Point Sharpie® products, such that the plurality of products 400 snap into place when inserted into the plurality of cavities 304. In some embodiments, as shown in FIG. 6B, at least a portion of the plurality of cavities 304 are configured to receive a plurality of Ultra Fine Point Sharpie® products, such that the plurality of products 400 snap into place when inserted into the plurality of cavities 304. In these embodiments, the plurality of cavities 304 are configured such that it is easier for a user to remove the plurality of products 400 from the plurality of cavities 304. As used herein, the term "plurality of products" can refer to a plurality of writing instruments, or other types of products, including but not limited to Sharpie®, Paper Mate®, Elmer's®, and Yankee Candle® products.

In one embodiment, as in FIGS. 1-3 and 6A-H, the plurality of cavities 304 may be configured to receive a plurality of writing instruments. In this embodiment, the diameter of the wheel 300 is less than about 16 inches. In this embodiment, the length of each of the plurality of products 400 is less than about 8 inches. In this embodiment, the plurality of writing instruments are disposed within the plurality of cavities 304 on the wheel 300. For example, the plurality of cavities 304 may be configured such that the tips of each of the plurality of writing instruments are disposed near the circumference of the wheel 300, and the bases of each of the plurality of writing instruments are disposed near the protrusion 204, or vice versa. The plurality of cavities 304 may have different shapes and sizes in order to receive different pluralities of products 400.

In some embodiments, the wheel 300 may be formed of two semicircular half-trays 300*a* and 300*b*. In these embodiments, the two semicircular half-trays 300*a* and 300*b* fit together to form a circle.

Figure 8A:
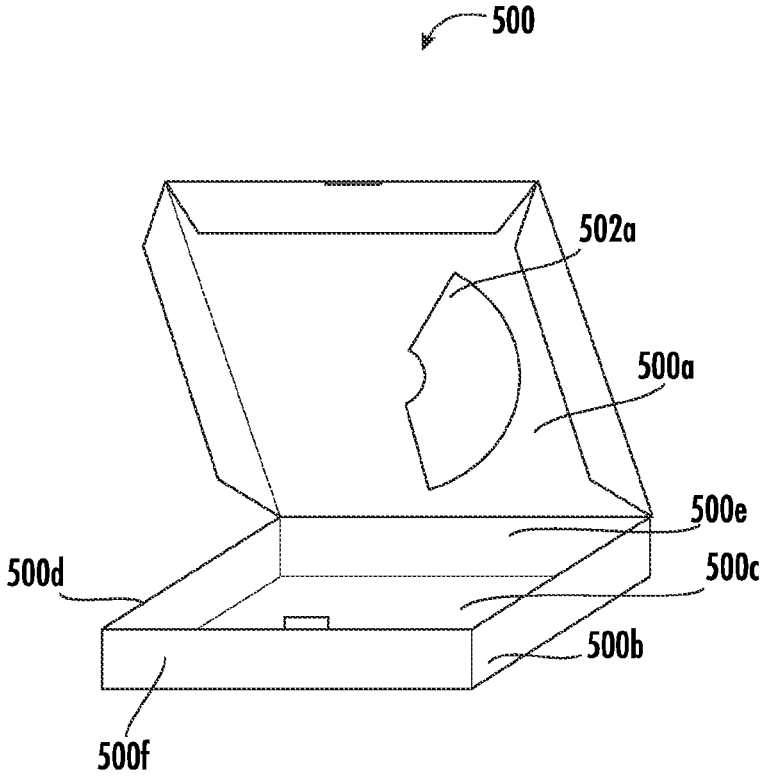
FIG. 8A is a perspective view of a first step in assembling an embodiment of a spinnable package assembly according to the present disclosure.
Figure 8B:
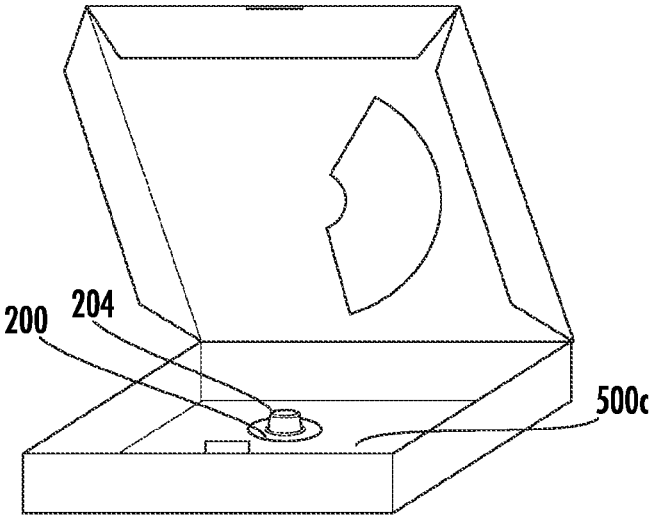
FIG. 8B is a perspective view of a second step in assembling the spinnable package assembly of FIG. 8A.
Figure 8C:
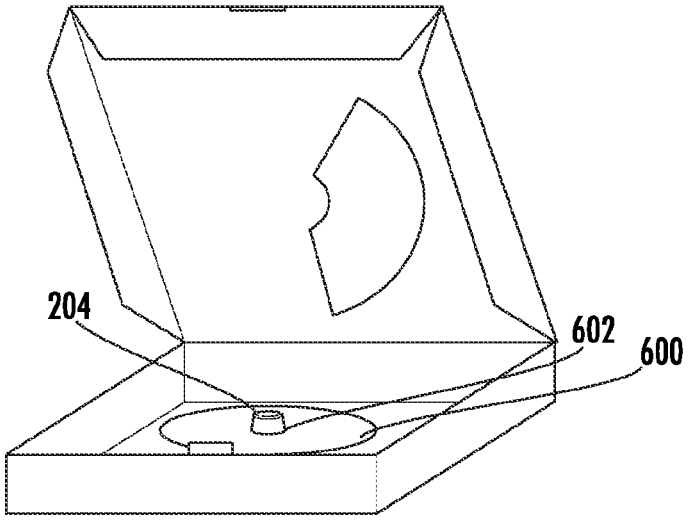
FIG. 8C is a perspective view of a third step in assembling the spinnable package assembly of FIG. 8A.

In some embodiments, as shown in FIGS. 8A-C, the spinnable package assembly 100 includes an outer box 500. The outer box 500 may include a first face 500*a*, a second face 500*b*, a third face 500*c*, a fourth face 500*d*, a bottom face 500*e*, and a top face 500*f*. The second face 500*b* is adjacent to the first face 500*a*, the third face 500*c* is adjacent to the second face 500*b* and is disposed parallel to the first face 500*a*, the fourth face 500*d* is adjacent to the third face 500*c* and is disposed parallel to the second face 500*b*. The bottom face 500*e* is adjacent to the first face 500*a*, the second face 500*b*, the third face 500*c*, and the fourth face 500*d*. The top face 500*f* is adjacent to the first face 500*a*. In some instances, the first face 500*a* may be movable between a closed configuration and an open configuration. For example, in a closed configuration, the first face 500*a* is disposed parallel to the third face 500*c*, and is adjacent to the second face 500*b*, the fourth face 500*d*, the bottom face 500*e*, and the top face 500*f*. In an open configuration, the first face 500*a* is adjacent to the bottom face 500*e* only. The outer box 500 may be formed of paper, cardboard, or other materials.

In certain embodiments, as in FIGS. 8A-C, the first face 500*a* may include a first cutout 502*a*. In certain embodiments, the third face 500*c* may include a second cutout (not shown). In some instances, the first cutout 502*a* and/or the second cutout are quarter-circular. In other instances, the first cutout 502*a* and/or the second cutout are semicircular. In other instances, the first cutout 502*a* and/or the second cutout may be in the shape of part of a circle. In other embodiments, the first cutout 502*a* and/or the second cutout 502*b* may have various shapes and sizes.

In certain embodiments, as shown in FIGS. 8A-C, the outer box 500 is configured to substantially enclose the base 200 and the wheel 300. In these embodiments, the length of the outer box 500 is substantially equal to the diameter of the wheel 300, the width of the outer box 500 is substantially equal to the diameter of the wheel 300, the height of the outer box 500 is substantially equal to the height of the base 200, and the depth of the outer box 500 is substantially equal to the depth of the base 200. In some instances, the outer box 500 may be rectangular, square, or some other three-dimensional shape configured to substantially enclose the base 200 and the wheel 300.

A method for assembling a spinnable package assembly 100 is shown in FIGS. 8A-C. First, as shown in FIG. 8A, an outer box 500 is disposed in an open configuration. Second, as shown in FIG. 8B, the base 200 is then disposed in the center of the third face 500*c*, such that the protrusion 204 is faced in an upwards direction. Third, as shown in FIG. 8C, a stabilizing insert 600 is provided to secure the protrusion 204. The stabilizing insert 600 may be formed of corrugated cardboard. The stabilizing insert may include a through hole 602 in the center of the stabilizing insert 600 to provide a passage for the protrusion 204 therethrough. The stabilizing insert 600 may selectively attach to or be configured to retain the base 200 within the outer box 500. Next, a wheel 300 may be spinnably mounted on the base 200 when the protrusion 204 is positioned in the aperture 302. For example, the products may be loaded into a first surface of the wheel, i.e., into the cavities, and then the aperture of the wheel may be configured such that the wheel is flipped and placed onto the protrusion 204. Thus, second surface of the wheel may be exposed through a window in the face of the outer box, as described herein. This may beneficially retain the products within the wheel and outer box, while providing a visual display of the products through the window, while preventing someone from removing a product from the wheel when the wheel is positioned within the outer box. In this embodiment, the wheel 300 is spinnable about a longitudinal axis of the protrusion 204.

It will be apparent to those skilled in the art that various modifications and variations can be made to the present disclosure without departing from the scope of the invention. Thus, it is intended that the present disclosure cover the modifications and variations of this invention provided they come within the scope of the appended claims and their equivalents.

What is claimed is:

1. A spinnable package assembly, comprising:
- a base, comprising:
  - a plate comprising:
    - a top surface;
    - an opposed bottom surface;
    - a first raised platform at a first corner of the top surface of the plate; and
    - a second raised platform at a second corner of the top surface of the plate,
  - wherein the plate is square; and
  - a protrusion extending from the top surface of the plate; and
- a wheel configured to removably secure a plurality of products, the wheel comprising an aperture extending therethrough, wherein the wheel and the base are sized and shaped such that the wheel is spinnably mountable on the base when the protrusion is positioned in the aperture, such that the wheel is spinnable about a longitudinal axis of the protrusion;
- an outer box configured to substantially enclose the base and the wheel, comprising:
  - a first face comprising a first cutout;
  - a second face adjacent to the first face;
  - a third face, wherein the third face is adjacent to the second face and is opposed to the first face;
  - a fourth face, wherein the fourth face is adjacent to the third face and is opposed to the second face;
  - a bottom face, wherein the bottom face is adjacent to the first face, the second face, the third face, and the fourth face; and
  - a top face adjacent to the first face,
- wherein the top face is movable between a closed configuration in which the top face is adjacent to the first face, the second face, the third face, and the fourth face, and the top face is opposed to the bottom face, and an open configuration, in which the top face is adjacent to the first face; and
- a stabilizing insert securing the protrusion, wherein the wheel is disposed on the stabilizing insert when the wheel is spinnably mounted on the protrusion, and wherein a diameter of the stabilizing insert is substantially equal to a length of the outer box.

2. The spinnable package assembly of claim 1, wherein the protrusion is substantially cylindrical.

3. The spinnable package assembly of claim 1, wherein the aperture is substantially circular.

4. The spinnable package assembly of claim 1, wherein the protrusion extends from a center of the top surface of the plate.

5. The spinnable package assembly of claim 1, wherein the aperture is disposed at a center of the wheel.

6. The spinnable package assembly of claim 1, wherein a length of the plate is greater than a diameter of the wheel.

7. The spinnable package assembly of claim 6, wherein the plate further comprises:
- a third raised platform at a third corner of the top surface of the plate; and
- a fourth raised platform at a fourth corner of the top surface of the plate.

8. The spinnable package assembly of claim 1, wherein the plate is circular, and wherein a diameter of the plate is greater than a diameter of the aperture.

9. The spinnable package assembly of claim 1, wherein the wheel comprises:
- a first semicircular half-tray; and
- a second semicircular half-tray,
- wherein the first semicircular half-tray and the second semicircular half-tray together form a circle.

10. The spinnable package assembly of claim 1, wherein the length of the outer box is substantially equal to a diameter of the wheel, wherein a width of the outer box is substantially equal to the diameter of the wheel, wherein a height of the outer box is substantially equal to a height of the base, and wherein a depth of the outer box is substantially equal to a depth of the base.

11. The spinnable package assembly of claim 1, wherein a diameter of the wheel is less than about 16 inches.

12. The spinnable package assembly of claim 11, wherein a respective length of each of the plurality of products is less than about 8 inches.

13. The spinnable package assembly of claim 1, wherein the first cutout is quarter-circular.

14. The spinnable package assembly of claim 1, wherein the first cutout is semicircular.

15. The spinnable package assembly of claim 1, wherein the plurality of products comprises a plurality of writing instruments.

16. The spinnable package assembly of claim 15, wherein the wheel comprises a plurality of cavities configured to receive the plurality of writing instruments.

17. The spinnable package assembly of claim 16, wherein a respective first end of each of the plurality of cavities is disposed proximal to the protrusion, and wherein a respective second end of each of the plurality of cavities is disposed proximal to a circumference of the wheel.

18. The spinnable package assembly of claim 1, wherein the wheel comprises a plurality of cavities configured to receive the plurality of products.

19. The spinnable package assembly of claim 18, wherein a respective first end of each of the plurality of cavities is disposed proximal to the protrusion, and wherein a respective second end of each of the plurality of cavities is disposed proximal to a circumference of the wheel.

* * * * *